US006085393A

United States Patent [19]

Tsui et al.

[11] Patent Number: 6,085,393

[45] Date of Patent: Jul. 11, 2000

[54] BADGE STRAP ATTACHMENT

[75] Inventors: Ping Tsui, Lexington; Peter K. Scott, Waban, both of Mass.; Robert N. Brosofsky, Nashua, N.H.; Keith D. Cargill, Cambridge; Richard M. Raia, Lexington, both of Mass.

[73] Assignee: Comprehensive Identification Products, Inc., Burlington, Mass.

[21] Appl. No.: 09/103,038

[22] Filed: Jun. 23, 1998

[51] Int. Cl.[7] ..... A44B 21/00

[52] U.S. Cl. ..... 24/3.12

[58] Field of Search ..... 40/1.5, 1.6, 666; 24/3.12, 3.11, 3.1

[56] References Cited

U.S. PATENT DOCUMENTS

| | | | |
|---|---|---|---|
| D. 342,280 | 12/1993 | Revis | D19/65 |
| 1,388,219 | 8/1921 | Thompson . | |
| 1,965,862 | 7/1934 | Seuel | 40/1.6 |
| 2,328,206 | 8/1943 | Fowler | 40/1.5 |
| 2,441,002 | 5/1948 | Berglund | 40/16 |
| 2,548,104 | 4/1951 | Frison | 40/1.6 |
| 2,659,013 | 11/1953 | Davis et al. | 250/83 |
| 2,874,495 | 2/1959 | Fowler | 40/1.5 |
| 2,877,578 | 3/1959 | Klitzner | 40/1.5 |
| 3,054,201 | 9/1962 | Burns | 40/1.5 |
| 3,237,326 | 3/1966 | Naffin | 40/1.5 |
| 3,462,862 | 8/1969 | Chase | 40/1.5 |
| 3,810,321 | 5/1974 | Kiba | 40/1.5 |
| 4,098,014 | 7/1978 | Lauer et al. | 40/1.5 |
| 4,137,657 | 2/1979 | Wardle | 40/1.5 |
| 4,187,628 | 2/1980 | Thompson | 40/10 D |
| 4,261,121 | 4/1981 | Coon . | |
| 4,277,864 | 7/1981 | Orson, Sr. | 24/327 |
| 4,809,406 | 3/1989 | Tsai . | |
| 5,088,013 | 2/1992 | Revis | 362/99 |
| 5,117,538 | 6/1992 | Henry | 24/298 |
| 5,208,486 | 5/1993 | Revis | 307/122 |
| 5,283,966 | 2/1994 | Rader et al. | 40/1.5 |
| 5,361,463 | 11/1994 | Revis | 24/543 |
| 5,452,500 | 9/1995 | Revis | 24/543 |
| 5,564,166 | 10/1996 | Roy | 24/3.11 |
| 5,640,742 | 6/1997 | White et al. | 24/3.12 |

*Primary Examiner*—James R. Brittain
*Attorney, Agent, or Firm*—Hamilton, Brook, Smith & Reynolds

[57] ABSTRACT

A badge strap attachment includes a clothing attachment member for attaching to clothing of a user. A badge coupling member is secured to the clothing attachment member. The badge coupling member is capable of forming a closed loop for coupling to a badge through a slot in the badge. A secondary mounting fixture on the badge coupling member enables a supplemental display surface to be mounted to the badge coupling member above the badge and simultaneously displayed.

26 Claims, 6 Drawing Sheets

BADGE STRAP ATTACHMENT

BACKGROUND

Identification cards or badges are often worn by employees while at work, attendees at conventions and seminars, or any individual requiring a visible identification document. Such badges are typically attached to clothing with a clip-on or pin-on style badge strap attachment. One common clip-on or pin-on badge strap attachment includes a flexible plastic strap which is secured to a spring clip or pin. Mating male and female snap-fittings are secured to the flexible strap and are spaced apart from each other. When the male and female snap-fittings are engaged with each other, a closed loop is formed in the strap for coupling to the badge through a slot in the card or badge. In use, the end of the flexible strap is passed through the slot in the badge and the snap-fittings engaged with each other to couple the badge with the closed loop. The spring clip or pin is usually fastened to the clothing of the user, thereby fastening the badge to the user.

SUMMARY OF THE INVENTION

The present invention provides a badge strap attachment capable of simultaneously securing and displaying a supplemental display surface above an identification badge without requiring substantial structure. The badge strap attachment of the present invention includes a clothing attachment member for attaching to clothing of a user. A badge coupling member is secured to the clothing attachment member. The badge coupling member is capable of forming a closed loop for coupling to a badge through a slot in the badge. A secondary mounting fixture on the badge coupling member enables a supplemental display surface to be mounted to the badge coupling member above the badge and simultaneously displayed.

In preferred embodiments, the clothing attachment member is preferably a spring clip and the badge coupling member is a flexible strap. A strap closure including male and female strap-fittings is mounted on the flexible strap for engaging with each other, thereby enabling the strap to be securable to itself to form the closed loop. The secondary mounting fixture is a female snap-fitting secured to the flexible strap and spaced apart from the strap closure for engaging a protrusion extending from the supplemental display surface. The fittings of the strap closure extend from one face of the strap while the fitting of the secondary mounting fixture extends from the strap on an opposing face. The flexible strap extends downwardly from the clothing attachment member and then upwardly when the flexible strap is secured to itself to form the closed loop.

The present invention badge strap attachment allows the user to display more information in a visually pleasing than obtainable with previous badge strap attachments of similar style with the addition of minimal structure.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 2:
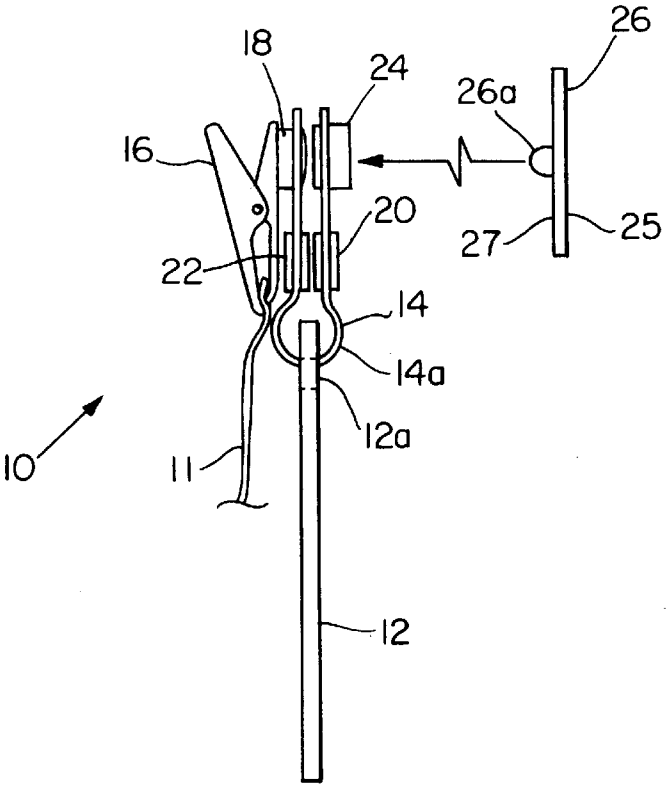
FIG. 2 is a side view of the badge strap attachment of FIG. 1.
Figure 1:
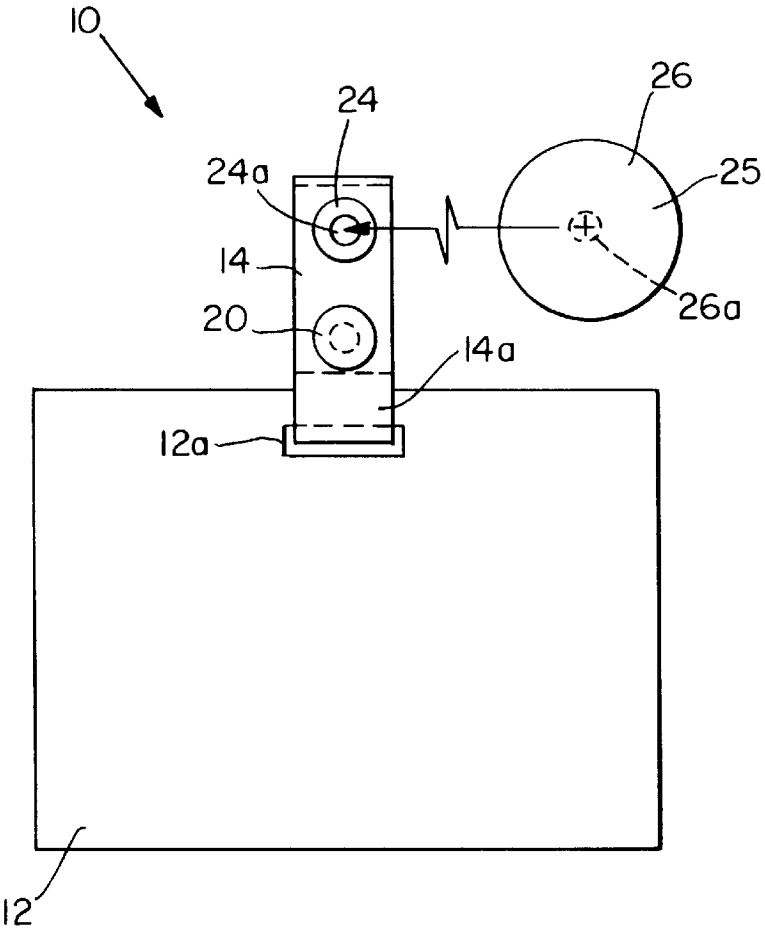
FIG. 1 is a front view of the present invention badge strap attachment secured to a badge.
Figure 3:
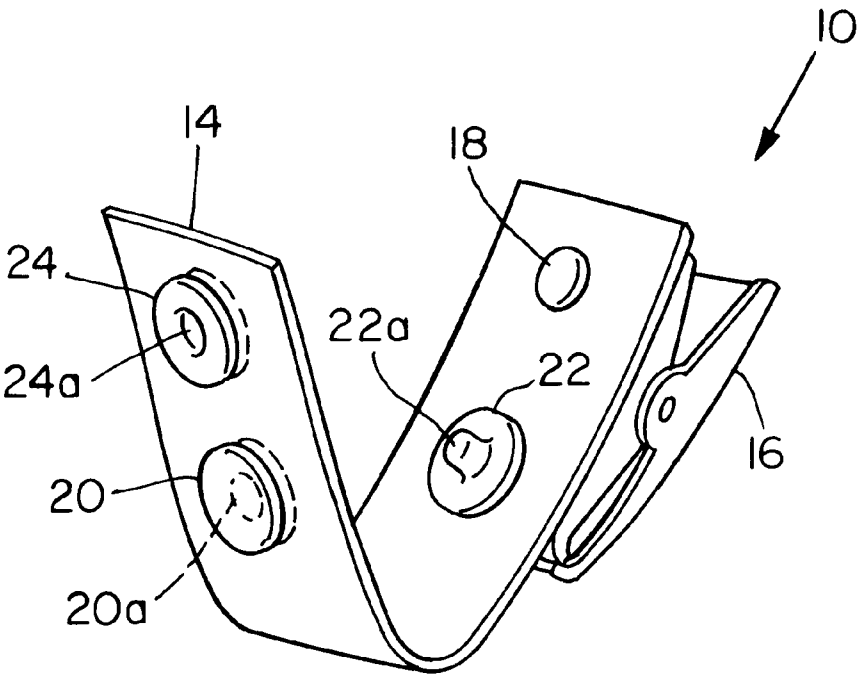
FIG. 3 is a perspective view of the present invention badge strap attachment in an opened position.

Referring to FIGS. 1, 2 and 3, badge strap attachment 10 is capable of securing an identification card or badge 12 to the clothing 11 of a user while at the same time displaying a smaller additional or supplemental display surface 26 positioned above the badge 12. Badge strap attachment 10 includes a flexible plastic strap 14 having a proximal end which is rotatably secured to a spring loaded clip 16 by a rivet or eyelet 18. Strap 14 is preferably made of clear flexible plastic but, alternatively, can be made of colored plastic, fabric, leather, etc. A male snap-fitting 22 having a protrusion 22*a* is secured to strap 14 below rivet 18. Protrusion 22*a* extends from the face of strap 14 which faces away from spring clip 16. A mating female snap-fitting 20 having a socket 20*a* for accepting protrusion 22*a* is secured to strap 14 and is spaced apart from male snap-fitting 22. Protrusion 22*a* and socket 20*a* are located on the same face of strap 14 allowing protrusion 22*a* to engage within socket 20*a*. Engaging fittings 20 and 22 together secures strap 14 to itself to form a releasably closed loop 14*a* below snap-fittings 20/22 for coupling to badge 12 through slot 12*a*. A second female snap-fitting 24 is spaced apart from female snap-fitting 20 on strap 14 and is secured at the distal end of strap 14. The socket 24*a* of snap-fitting 24 extends from the face of strap 14 which is opposite to the face from which socket 20*a* and protrusion 22*a* extend. When strap 14 is in the closed position with fittings 20 and 22 engaged, female snap-fitting 24 is located above female snap-fitting 20 with socket 24*a* facing in the direction away from spring clip 16.

A supplemental display surface 26 is securable to badge strap attachment 10 with female snap-fitting 24. Supplemental display surface 26 has a front display surface 25 and a rear mounting surface 27 having a male snap-fitting protrusion 26*a* extending therefrom. The male protrusion 26*a* of supplemental display surface 26 is pressed or snapped into socket 24*a* of snap-fitting 24 for securing supplemental display surface 26 to strap 14 of badge strap attachment 10. Strap 14 is made stiff enough to support the weight of supplemental display surface 26.

Supplemental display surface 26 may include custom or generic information such as employee names, company names, logos, decorative designs, etc. Supplemental display surface 26 is typically metallic with an enamel display surface 25 but, alternatively, can be made of plastic or other suitable materials. Although supplemental display surface 26 is shown to be round, supplemental display surface 26 can be any suitable shape such as oval, rectangular, triangular, etc. In addition, supplemental display surface 26 can have the shape of a desired figure or object, for example, a crest, sports symbol, house, tree, person, animal, or any inanimate object, etc.

In one preferred embodiment, strap 14 is about 2¾ inches long, ½ inch wide and 0.034 inches thick. Snap-fitting 22 is spaced apart from rivet 18 about ½ inch, snap-fitting 20 is spaced apart from snap-fitting 22 about 1¼ inches (when strap 14 is in a flattened state), and snap-fitting 24 is spaced apart from snap-fitting 20 about ½ inch. Alternatively, other suitable dimensions can be employed depending upon the size of badge 12 and spring clip 16. In addition, although snap-fitting 22 and protrusion 26*a* have been shown and described to be male fittings, and fittings 20/24 to be female, alternatively, snap-fitting 22 and protrusion 26*a* can be female and fittings 20/24 male. If fitting 24 is male, supplemental display surface 26 then has a female socket on rear mounting surface 27. Spring clip 16 and snap-fittings 20, 22, 24 and protrusion 26*a* are preferably metallic but, alternatively, can be made of other suitable materials such as plastic or other. Furthermore, if snap-fittings 20, 22 and 24 are plastic, those snap-fittings can be molded as part of strap 14.

In operation, badge strap attachment 10 is secured to identification badge 12 by first disengaging protrusion 22*a* of male snap-fitting 22 from socket 20*a* of female snap-fitting 20 to open loop 14*a*. Strap 14 is then inserted through slot 12*a* in identification badge 12. Protrusion 22*a* of male snap-fitting 22 is re-engaged with socket 20*a* of female snap-fitting 20 securing strap 14 to itself and re-closing loop 14*a*, thereby coupling identification badge 12 to badge strap attachment 10. Supplemental display surface 26 is secured to strap 14 above the identification badge 12 by engaging male protrusion 26*a* of supplemental display surface 26 with socket 24*a* of female snap-fitting 24. Supplemental display surfaces 26 of any suitable size, shape, color or design can be secured to snap-fitting 24. Badge strap attachment 10 is secured to the clothing 11 of the user by pressing the wings of spring clip 16 towards each other to open the jaws of clip 16 and then releasing them so that the jaws engage the clothing 11. Spring clip 16 can swivel relative to strap 14 so that clip 16 can clip to pockets, belts, etc. in any orientation.

Figure 5:
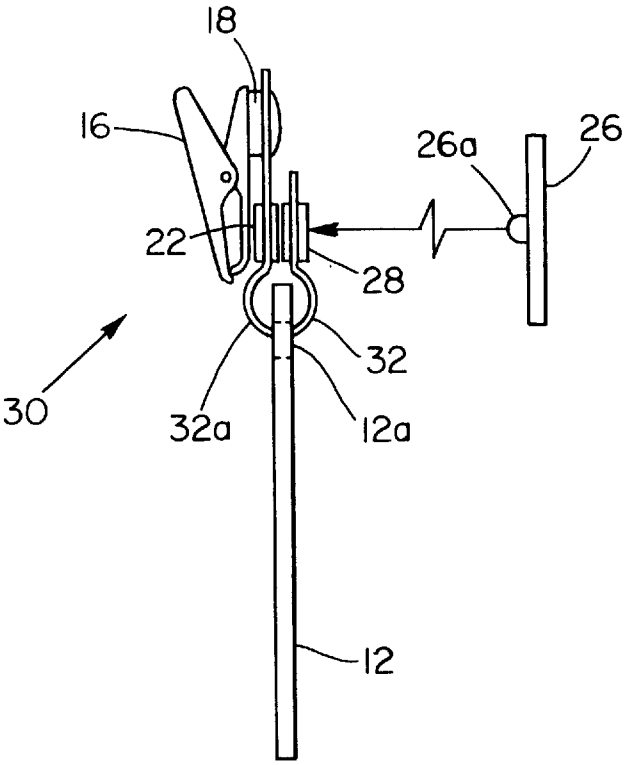
FIG. 5 is a side view of the badge strap attachment of FIG. 4.
Figure 4:
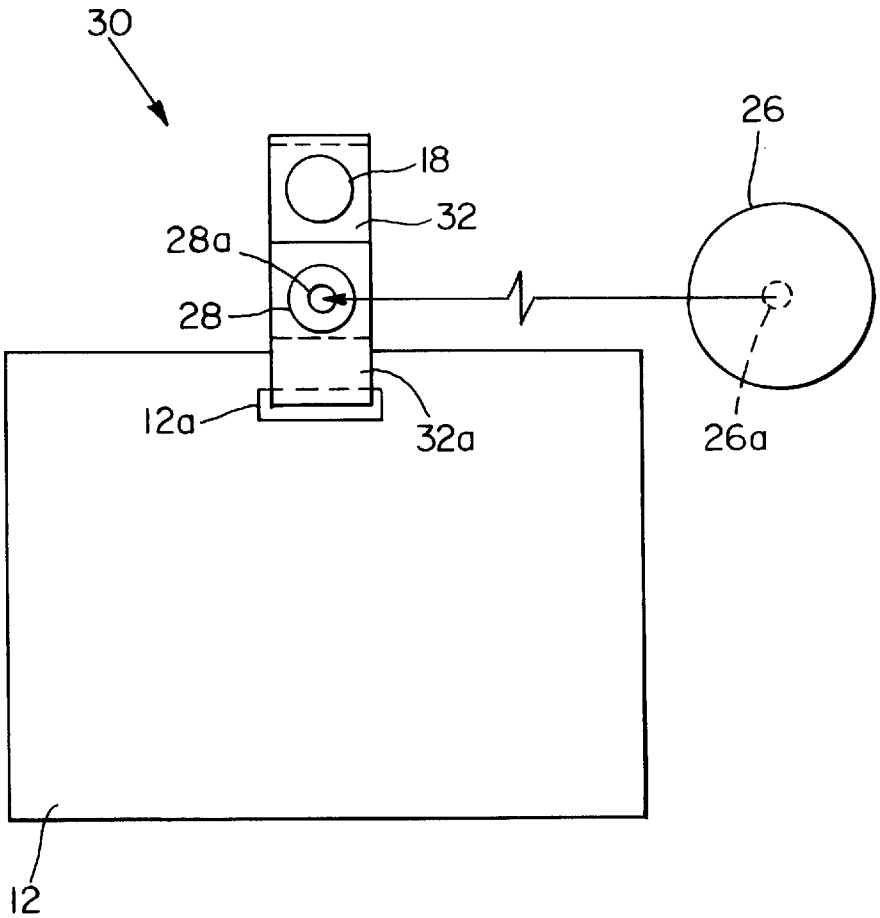
FIG. 4 is a front view of another preferred badge strap attachment secured to a badge.

Referring to FIGS. 4 and 5, badge strap attachment 30 differs from badge strap attachment 10 in that a strap 32 is secured to spring clip 16 by rivet or eyelet 18. A snap-fitting 28 is secured to strap 32 and spaced apart from male snap-fitting 22. Snap-fitting 28 includes a socket 28*a* extending from both faces of strap 32 for engagement with protrusion 22*a* of male snap-fitting 22 on one face of strap 32 and protrusion 26*a* of supplemental display surface 26 on the opposite face of strap 32. If desired, strap 32 can terminate just above fitting 28 as shown or extend to the full height of strap 14 depicted in FIG. 2. When snap-fittings 22 and 28 are engaged, strap 32 forms a releasably closed loop 32*a* for coupling to badge 12 via slot 12*a*. Although protrusion 26*a* of supplemental display surface 26 preferably engages with fitting 28, alternatively, rivet 18 can be made with a female socket for accepting protrusion 26*a*.

Figure 7:
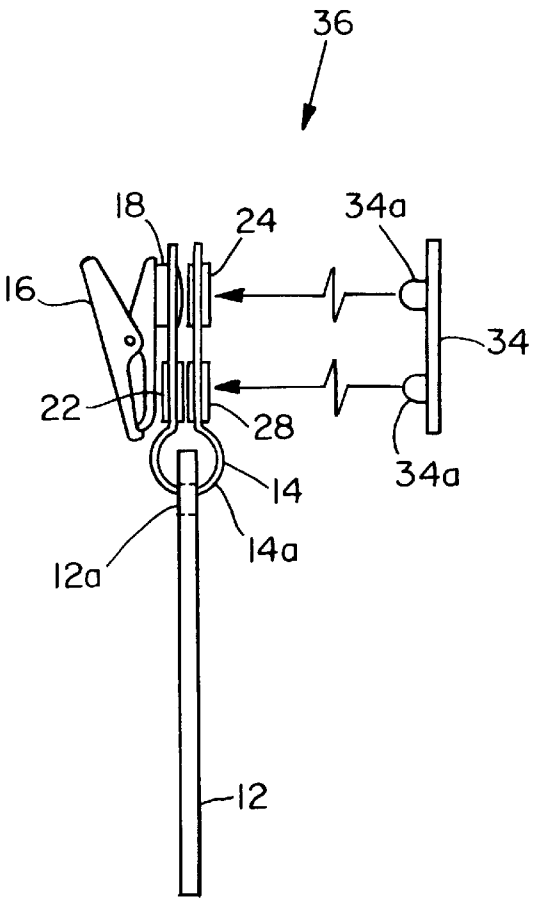
FIG. 7 is a side view of the badge strap attachment of FIG. 6.
Figure 6:
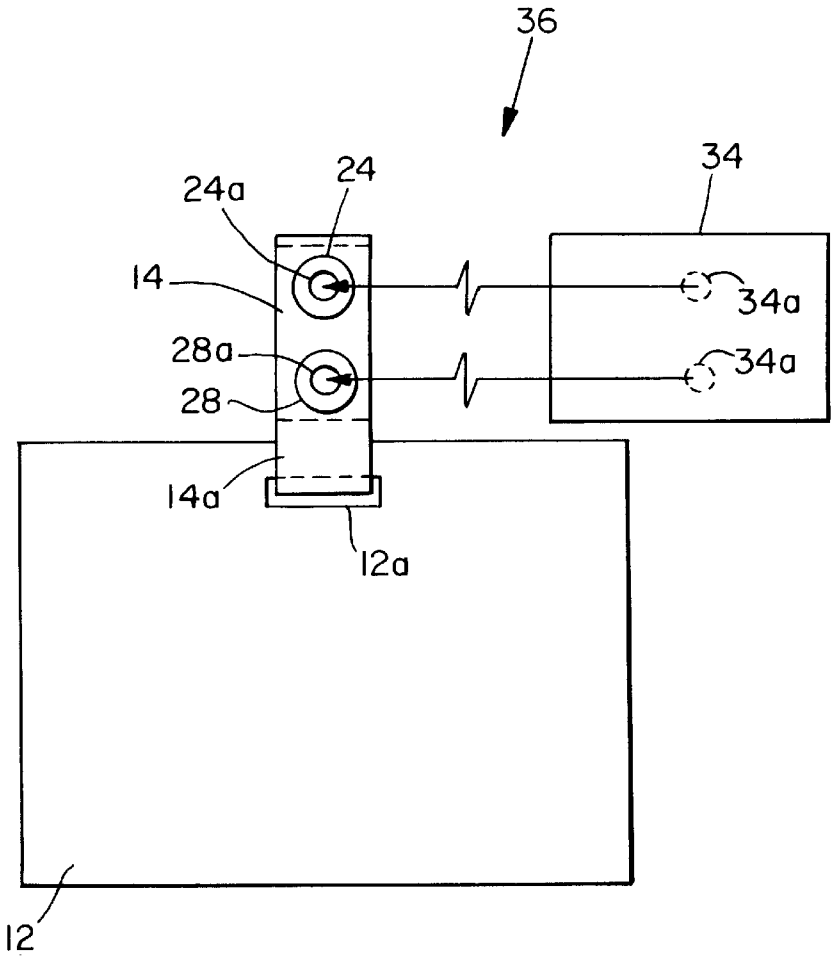
FIG. 6 is a front view of still another preferred badge strap attachment secured to a badge.

Referring to FIGS. 6 and 7, supplemental display surface 34 has two male snap-fitting protrusions 34*a* extending from the rear mounting surface of supplemental display surface 34. Badge strap attachment 36 differs from badge strap attachment 10 in that strap 14 includes both snap-fittings 28 and 24 for engaging with the two male protrusions 34*a* of supplemental display surface 34. Supplemental display surface 34 is typically larger than supplemental display surface 26 and requires two protrusions 34*a* for additional support and uniform lateral alignment. Two protrusions 34*a* are also desirable when rotation of the supplemental display surface 34 is unwanted. Fitting 28 can be replaced by a single sided female snap-fitting 20, which only mates with fitting 20. In such a case, strap 14 is extended upwardly to accommodate a second female snap-fitting 24 above the first fitting 24 to mate with protrusions 34*a*.

Figure 9:
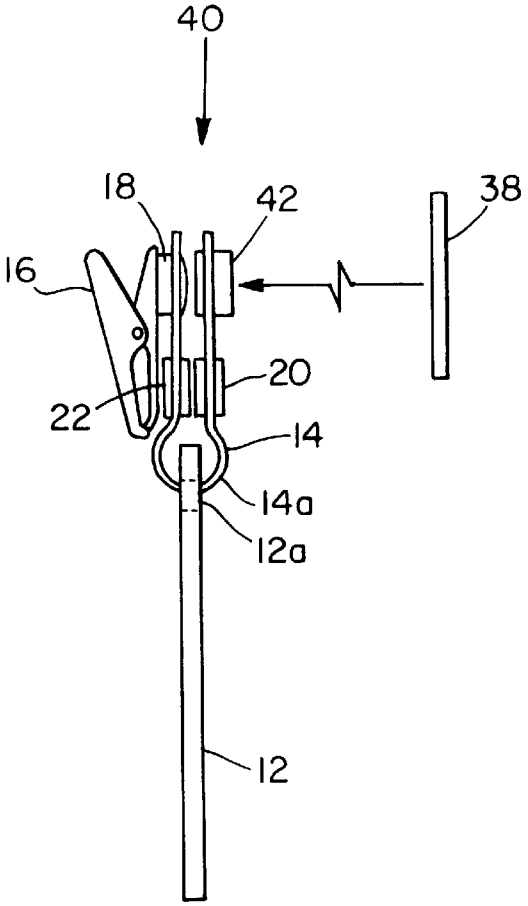
FIG. 9 is a side view of the badge strap attachment of FIG. 8.
Figure 8:
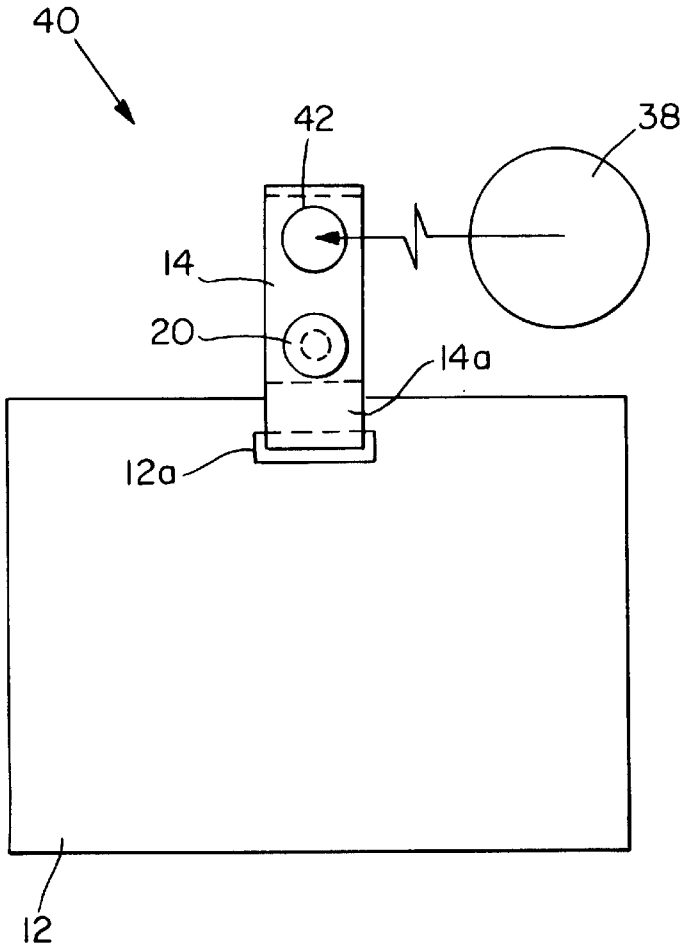
FIG. 8 is a front view of yet another preferred badge strap attachment secured to a badge.

Referring to FIGS. 8 and 9, badge strap attachment 40 differs from badge strap attachment 10 in that a magnet 42 is secured to strap 14 at about the same location as snap-fitting 24 of badge strap attachment 10. Magnet 42 preferably extends from the face of strap 14 that is opposite to the face from which socket 20*a* and protrusion 22*a* extend. Magnet 42 allows a metallic supplemental display surface 38 to be magnetically secured to strap 14. Although magnet 42 is preferably located at the position shown, alternatively, magnet 42 can be positioned on top of fitting 20. In addition, badge strap attachment 40 can include a magnet 42 at two locations, the first at the location shown and the second over fitting 20.

Figure 10:
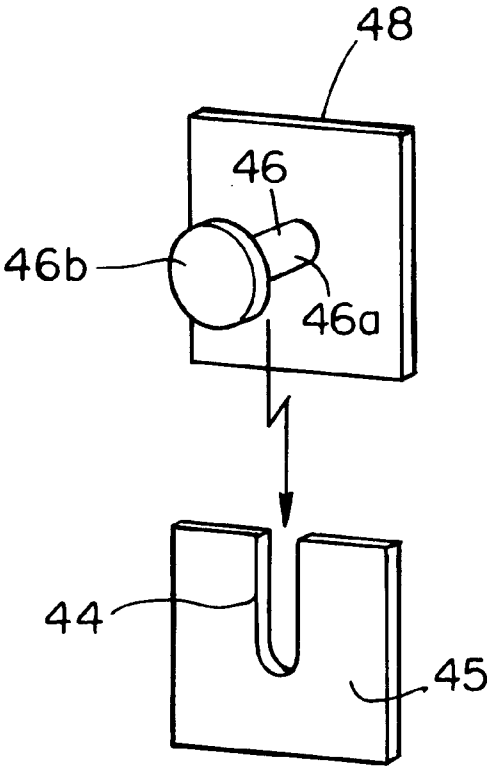
FIG. 10 is a perspective view of another preferred method of securing a supplemental display surface.

FIG. 10 depicts another preferred method of securing a supplemental display surface 48 to strap 14. Supplemental display surface 48 includes a stem 46 having a post 46*a* and a head 46*b*. A slotted fitting 45 is secured to strap 14, the post 46*a* of stem 46 slides into slot 44 of fitting 45 and is held in place by the opposed surfaces of head 46*b* and the supplemental display surface 48.

Figure 12:
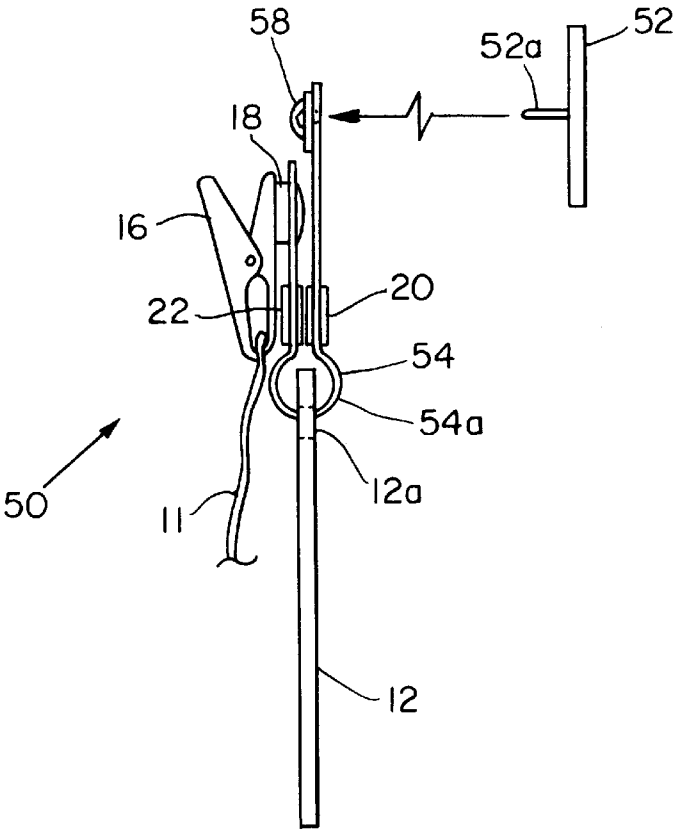
FIG. 12 is a side view of the badge strap attachment of FIG. 11
Figure 11:
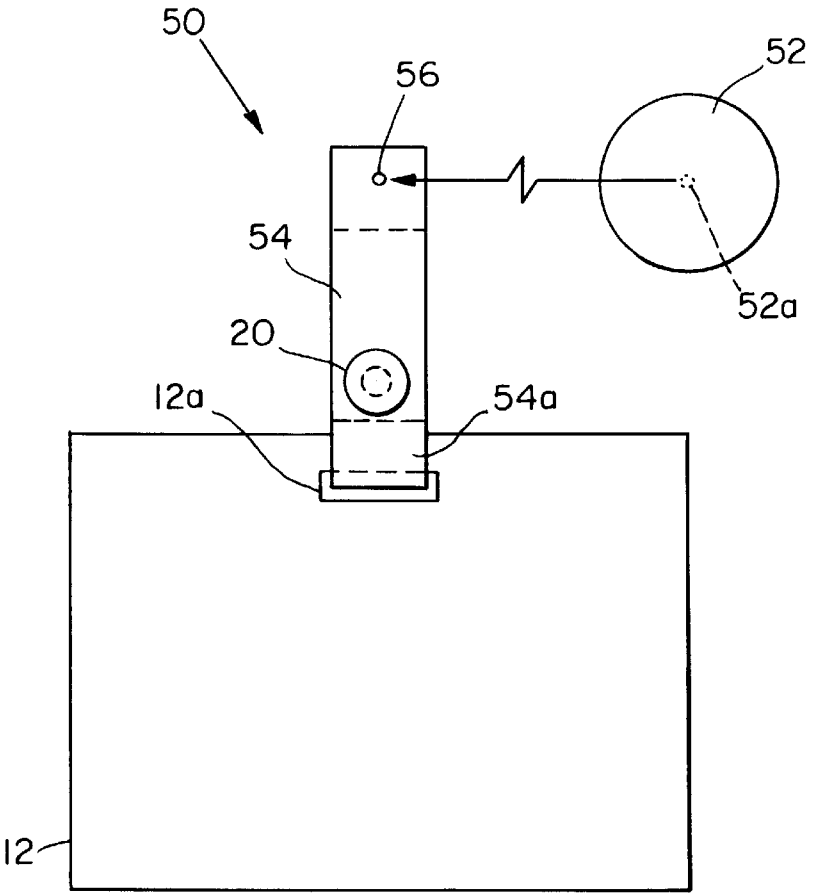
FIG. 11 is a front view of still another preferred badge strap attachment secured to a badge.

Referring to FIGS. 11 and 12, badge strap attachment 50 provides for the securement of a supplemental display surface 52 having a pin 52*a* extending from the rear surface. Badge strap attachment 50 differs from badge strap attachment 10 in that strap 54 of badge strap attachment 50, when coupled to badge 12 by loop 54*a*, has a portion which extends slightly above spring clip 16. The extended portion of strap 54 includes a small hole 56 which allows pin 52*a* of supplemental display surface 52 to be inserted therethrough and secured on the backside of strap 54 by a pin clutch 58. Pin clutch 58 is similar to those used for tie pins, earings etc. The pin clutch 58 is typically separate or separable from strap 54, but alternatively, can be permanently secured thereon.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

For example, although snap-fittings, pin clutches and magnets have been shown for securing the supplemental display surface to the present invention badge strap attachment, alternatively, other suitable means of attachment can be employed such as, pressure sensitive adhesive or Velcro®. In addition, Velcro® can be employed to replace snap-fittings 20 and 22. Furthermore, although a spring clip 16 has been shown to secure the present invention to a user's clothing, alternatively, other suitable means of attachment can be employed such as pins, magnets, one-piece clips, neck chains, adaptor straps, neck straps, etc. Finally, although the terms "above" and "below" have been used to describe the relative location of components in the present invention, such terms are not intended to limit the location or orientation of particular components but are merely employed to describe the orientation of components as shown in the figures. It is understood that the orientation of components can change, for example, by rotating the flexible strap relative to the spring clip 16 about rivet or eyelet 18.

What is claimed is:

1. A badge strap attachment comprising:

a clothing attachment member for attaching to clothing of a user;

a badge coupling member secured to the clothing attachment member, the badge coupling member capable of forming a closed loop for coupling to a badge through a slot in the badge; and a secondary mounting fixture on the badge coupling member for enabling a supplemental display surface to be mounted to the badge coupling member above the badge and simultaneously displayed.

2. The badge strap attachment of claim 1 in which the badge coupling member is a flexible strap that is securable to itself to form the closed loop.

3. The badge strap attachment of claim 2 further comprising a strap closure comprising male and female snap-fittings mounted on the flexible strap for engaging each other to form the closed loop.

4. The badge strap attachment of claim 3 in which the secondary mounting fixture is a female snap-fitting secured to the flexible strap for engaging a protrusion extending from the supplemental display surface.

5. The badge strap attachment of claim 4 in which the secondary mounting fixture is spaced apart from the strap closure.

6. The badge strap attachment of claim 5 in which the fittings of the strap closure extend from one face of the strap while the fitting of the secondary mounting fixture extends from the strap on an opposing face.

7. The badge strap attachment of claim 3 in which the flexible strap extends downwardly from the clothing attachment member and then upwardly when the flexible strap is secured to itself to form the closed loop.

8. The badge strap attachment of claim 3 in which the secondary mounting fixture comprises a hole through the strap for engaging a pin extending from the supplemental display surface.

9. The badge strap attachment of claim 8 in which the secondary mounting fixture further comprises a pin clutch for engaging the pin of the supplemental display surface.

10. The badge strap attachment of claim 1 in which the clothing attachment member is an spring clip.

11. A badge strap attachment comprising:

a flexible strap that is securable to itself to form a closed loop for coupling to a badge through a slot in the badge;

a clip attached to said strap; and a secondary mounting fixture on the flexible strap for enabling a supplemental display surface to be mounted adjacent to the badge and simultaneously displayed.

12. The badge strap attachment of claim 11 further comprising a strap closure comprising male and female snap-fittings mounted on the flexible strap for engaging each other to form the closed loop.

13. The badge strap attachment of claim 12 in which the secondary mounting fixture is a female snap-fitting secured to the flexible strap for engaging a protrusion extending from the supplemental display surface.

14. The badge strap attachment of claim 13 in which the secondary mounting fixture is spaced apart from the strap closure.

15. The badge strap attachment of claim 14 in which the fittings of the strap closure extend from one face of the strap while the fitting of the secondary mounting fixture extends from the strap on an opposing face.

16. The badge strap attachment of claim 12 in which the flexible strap extends downwardly from the clip and then upwardly when the flexible strap is secured to itself to form the closed loop.

17. A method of forming a badge strap attachment comprising the steps of:

providing a clothing attachment member for attaching to clothing of a user;

securing a badge coupling member to the clothing attachment member, the badge coupling member capable of forming a closed loop for coupling to a badge through a slot in the badge; and securing a secondary mounting fixture to the badge coupling member for enabling a supplemental display surface to be mounted to the badge coupling member above the badge and simultaneously displayed.

18. The method of claim 17 in which the badge coupling member is a flexible strap, the method further comprising the step of mounting male and female snap-fittings on the flexible strap to form a strap closure, the snap-fittings capable of engaging with each other for securing the strap to itself to form the closed loop.

19. The method of claim 18 further comprising the step of securing a female snap-fitting to the flexible strap spaced apart from the strap closure to form the secondary mounting fixture for engaging a protrusion extending from the supplemental display surface.

20. A badge strap attachment comprising:

a clothing attachment member for attaching to clothing of a user;

a badge coupling member secured to the clothing attachment member, the badge coupling member comprising a flexible strap that is securable to itself to form a closed loop for coupling to a badge through a slot in the badge, a strap closure comprising male and female snap-fittings being mounted on the flexible strap for engaging each other to form the closed loop; and a secondary mounting fixture on the badge coupling member for enabling a supplemental display surface to be mounted on the badge coupling member above the badge and simultaneously displayed, the secondary mounting fixture being a female snap-fitting secured to the flexible strap for engaging a protrusion extending from the supplemental display surface.

21. The badge strap attachment of claim 20 in which the secondary mounting fixture is spaced apart from the strap closure.

22. The badge strap attachment of claim 21 in which the fittings of the strap closure extend from one face of the strap while the fitting of the secondary mounting fixture extends from the strap on an opposing face.

23. A badge strap attachment comprising:

a flexible strap that is securable to itself to form a closed loop for coupling to a badge through a slot in the badge;

a strap closure comprising male and female snap-fittings mounted on the flexible strap for engaging each other to form the closed loop;

a clip attached to said strap; and a secondary mounting fixture on the flexible strap for enabling a supplemental display surface to be mounted adjacent to the badge and simultaneously displayed, the secondary mounting fixture being a female snap-fitting secured to the flexible strap for engaging a protrusion extending from the supplemental display surface.

24. The badge strap attachment of claim 23 in which the secondary mounting fixture is spaced apart from the strap closure.

25. The badge strap attachment of claim 24 in which the fittings of the strap closure extend from one face of the strap while the fitting of the secondary mounting fixture extends from the strap on an opposing face.

26. A method of forming a badge strap attachment comprising the steps of:

providing a clothing attachment member for attaching to clothing of a user;

securing a badge coupling member to the clothing attachment member, the badge coupling member comprising a flexible strap capable of forming a closed loop for coupling to a badge through a slot in the badge, male and female snap-fittings mounted on the flexible strap forming a strap closure capable of engaging with each other for securing the strap to itself to form the closed loop; and securing a secondary mounting fixture to the badge coupling member for enabling a supplemental display surface to be mounted to the badge coupling member above the badge and simultaneously displayed, a female snap-fitting secured to the flexible strap and spaced apart from the strap closure forming the secondary mounting fixture for engaging a protrusion extending from the supplemental display surface.

* * * * *